US007814696B2

(12) United States Patent
Rapp et al.

(10) Patent No.: US 7,814,696 B2
(45) Date of Patent: Oct. 19, 2010

(54) PROJECTILE ACCELERATOR AND RELATED VEHICLE AND METHOD

(75) Inventors: John Rapp, Manassas, VA (US); Joseph R. Mayersak, Ashburn, VA (US); Mark Jones, Centreville, VA (US); Michael E. Feeley, Clifton, VA (US); Robert J. Howard, Clifton, VA (US); Robert J. Varley, Haymarket, VA (US); Stephen Melicher, Manassas, VA (US); Howard Taylor, Centreville, VA (US); Jyun-Horng Fu, Centreville, VA (US); Richard A. Udicious, Haymarket, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 994 days.

(21) Appl. No.: 11/264,299

(22) Filed: Oct. 31, 2005

(65) Prior Publication Data

US 2006/0265927 A1 Nov. 30, 2006

Related U.S. Application Data

(60) Provisional application No. 60/623,312, filed on Oct. 29, 2004.

(51) Int. Cl.
*F41A 19/58* (2006.01)
*F41A 1/10* (2006.01)

(52) U.S. Cl. ..... 42/84; 89/1.701; 89/28.05; 102/437

(58) Field of Classification Search ..... 42/84; 89/126, 127, 1.41, 1.7, 1.701; 102/401, 404–423, 102/437

See application file for complete search history.

(56) References Cited

U.S. PATENT DOCUMENTS

| | | | | | |
|---|---|---|---|---|---|
| 1,108,715 | A | | 8/1914 | Davis | |
| 1,108,717 | A | * | 8/1914 | Davis | 102/430 |
| 1,303,266 | A | | 5/1919 | Dougan | |
| 1,349,414 | A | * | 8/1920 | Dougan | 89/1.701 |
| 1,395,630 | A | * | 11/1921 | Davis | 89/1.701 |
| 2,156,605 | A | * | 5/1939 | Prettyman | 89/1.701 |
| 2,372,804 | A | * | 4/1945 | Vertzinsky | 102/405 |
| 2,466,714 | A | | 4/1949 | Kroeger et al. | |
| 2,679,192 | A | | 5/1954 | Seeley et al. | |
| 3,013,472 | A | | 12/1961 | Kahn et al. | |
| 3,149,531 | A | | 9/1964 | Musgrave | |
| 3,279,319 | A | * | 10/1966 | Semonian et al. | 89/1.81 |
| 3,324,767 | A | | 6/1967 | Alban | |
| 3,633,509 | A | * | 1/1972 | Grandy et al. | 102/338 |
| 3,648,611 | A | * | 3/1972 | Noel | 102/413 |
| 3,800,656 | A | * | 4/1974 | Schnabele | 89/1.701 |

(Continued)

*Primary Examiner*—Bret Hayes
(74) *Attorney, Agent, or Firm*—Mark A. Wurm; Bryan A. Santarelli; Graybeal Jackson LLP

(57) ABSTRACT

A projectile system includes an enclosure, first and second propellants, and first and second projectiles. The first and second propellants are disposed within the enclosure. The first projectile is disposed within the enclosure between the first propellant and a first end of the enclosure, and is operable to exit the enclosure via the first end in response to detonation of the first charge. The second projectile is disposed within the enclosure between the second propellant and a second end of the enclosure, and is operable to exit the enclosure via the second end in response to the detonation of the second propellant.

27 Claims, 6 Drawing Sheets

U.S. PATENT DOCUMENTS 3,815,469 A * 6/1974 Schubert et al. ..... 89/1.701
4,210,082 A * 7/1980 Brothers ..... 102/401
4,643,071 A 2/1987 Baechler et al.
5,361,373 A 11/1994 Gilson
5,883,329 A * 3/1999 O'Dwyer ..... 102/217
6,123,007 A 9/2000 O'Dwyer
6,138,395 A 10/2000 O'Dwyer
6,223,642 B1 5/2001 O'Dwyer
6,286,408 B1 * 9/2001 Sanford et al. ..... 89/1.701
6,301,819 B1 10/2001 O'Dwyer
6,343,553 B1 2/2002 O'Dwyer
6,431,076 B1 8/2002 O'Dwyer
6,477,801 B1 11/2002 O'Dwyer
6,510,643 B2 1/2003 O'Dwyer
6,543,174 B2 4/2003 O'Dwyer
6,557,449 B1 5/2003 O'Dwyer
6,701,818 B1 3/2004 O'Dwyer
6,715,398 B2 4/2004 O'Dwyer
6,722,252 B1 4/2004 O'Dwyer
6,782,826 B1 8/2004 O'Dwyer
6,860,187 B2 3/2005 O'Dwyer
6,889,935 B2 5/2005 O'Dwyer
7,487,302 B2 2/2009 Gouldey et al.
2002/0002787 A1 * 1/2002 O'Dwyer ..... 42/84
2002/0152918 A1 10/2002 O'Dwyer
2002/0157526 A1 10/2002 O'Dwyer
2003/0121404 A1 * 7/2003 O'Dwyer ..... 89/1.41
2003/0122032 A1 * 7/2003 O'Dwyer ..... 244/3.1
2004/0093783 A1 * 5/2004 O'Dwyer ..... 42/84
2004/0130927 A1 7/2004 Schulz et al.
2004/0133763 A1 7/2004 Mathur et al.
2004/0136241 A1 7/2004 Rapp et al.
2004/0170070 A1 9/2004 Rapp et al.
2004/0181621 A1 9/2004 Mathur et al.
2004/0231219 A1 * 11/2004 O'Dwyer ..... 42/84
2004/0237762 A1 12/2004 O'Dwyer
2005/0022657 A1 2/2005 O'Dwyer
2005/0081708 A1 * 4/2005 O'Dwyer ..... 89/37.16
2005/0246934 A1 * 11/2005 O'Dwyer ..... 42/84
2006/0085781 A1 4/2006 Rapp et al.
2006/0087450 A1 4/2006 Schulz et al.
2006/0101250 A1 5/2006 Rapp et al.
2006/0101253 A1 5/2006 Rapp et al.
2006/0101307 A1 5/2006 Rapp et al.
2006/0149920 A1 7/2006 Rapp et al.
2006/0230377 A1 10/2006 Rapp et al.

* cited by examiner

PROJECTILE ACCELERATOR AND RELATED VEHICLE AND METHOD

CLAIM OF PRIORITY

This application claims priority to U.S. Provisional Application Ser. No. 60/623,312 filed on Oct. 29, 2004, which is incorporated by reference.

BACKGROUND

Systems exist for firing a projectile to disable or destroy a stationary or moving target; some of these systems fire a guided projectile, and others of these systems fire an unguided projectile.

An example of a guided-projectile system is a submarine torpedo system, which fires a guided intercept torpedo from a launch tube to disable or destroy a target such as an enemy submarine, an enemy ship, or an incoming torpedo. Before firing the intercept torpedo, an operator maneuvers the submarine such that the launch tube, and thus the intercept torpedo within the tube, are aimed at the target. But because the intercept torpedo is a guided projectile, a guidance subsystem, which is disposed on the intercept torpedo and/or on the submarine and which monitors the location of the target using, e.g., sonar, can steer the intercept torpedo toward the target even after the intercept torpedo leaves the launch tube. Therefore, the guidance subsystem can correct the intercept torpedo's trajectory if the launch tube was inaccurately aimed at the target when the intercept torpedo was fired from the tube, if the intercept torpedo's trajectory is altered by an unaccounted for force (e.g., a current), or if the target changes course. Another example of a guided-projectile system is the ground-based Patriot® missile system, which aims an intercept missile at an incoming missile, fires the intercept missile, and, using phased-array radar, steers the fired intercept missile toward the incoming missile.

An example of an unguided-projectile system is a shipboard gun system, which fires an unguided shell to disable or destroy a target such as an enemy ship or aircraft. Before the gun fires the shell, an operator maneuvers the gun turret such that gun barrel, and thus the shell within the barrel, are aimed at the target. Because the shell is an unguided projectile, the gun cannot correct or otherwise affect the trajectory of the shell once the shell exits the barrel.

Guided- and unguided-projectile systems each have desirable features. For example, a guided projectile, such as a torpedo, is relatively small and can be unmanned, and an unguided projectile, such as a shell, is often relatively inexpensive to manufacture and maintain.

But unfortunately, guided- and unguided-projectile systems also have undesirable features.

Because a guided projectile, such as a torpedo, typically includes relatively complex subsystems, such as guidance, steering, power, and propulsion subsystems, a guided projectile is often relatively expensive to manufacturer and maintain. Furthermore, because a guided projectile is typically destroyed when it strikes a target, it is typically not reusable. Consequently, guided-projectile systems are often relatively expensive to maintain and operate because each time a guided projectile is launched, the projectile must be replaced.

Furthermore, an unguided-projectile system, such as a gun, often cannot be carried by an unmanned vehicle. For example, to accurately aim a ship-board gun barrel at a moving target, the gun's ranging subsystem computes the proper direction and azimuth of the gun barrel by executing a targeting algorithm that often accounts for the following factors:

the temperature, wind velocity, and other weather conditions, the position, velocity, and acceleration of the ship on which the gun is located, the position, velocity, and acceleration of the target, and the strike location of one or more previously fired shells. Because the targeting algorithm is so complex, the ranging subsystem often includes a relatively large computer subsystem that consumes a significant amount of power and that requires significant peripheral services (e.g., cooling). Moreover, the shell loading/unloading subsystem is often unsuitable for an underwater unmanned vehicle, because the water may corrode or otherwise damage components of the loading/unloading subsystem. In addition, the "jerking" motion that the recoil of a ship-board gun may impart to an unmanned vehicle may have undesirable consequences. For example, the recoil may damage the vehicle, or turn the vehicle such that the ranging subsystem must re-aim the gun before firing the next round. Consequently, the relatively large sizes of the computer subsystem and power supply and gun-recoil affects may render an unguided-projectile system unsuitable for an unmanned vehicle. Furthermore, the lack of a suitable projectile loading/unloading subsystem may render an unguided-projectile system unsuitable for an unmanned underwater vehicle.

Moreover, there are few, if any, unguided projectiles that are suitable for firing underwater. Because water is denser than air, unguided projectiles, such as bullets and shells, designed for above-water targets often experience significant drag in water, and thus often have a limited underwater range of a few tens of meters.

SUMMARY

According to an embodiment of the invention, an unguided projectile system includes an enclosure, first and second propellants, and first and second projectiles. The first and second propellants are disposed within the enclosure. The first projectile is disposed within the enclosure between the first propellant and a first end of the enclosure, and is operable to exit the enclosure via the first end in response to detonation of the first propellant. The second projectile is disposed within the enclosure between the second propellant and a second end of the enclosure, and is operable to exit the enclosure via the second end in response to the detonation of the second propellant.

As compared to prior unguided-projectile systems, such an unguided-projectile system is often more suitable for an unmanned vehicle and for underwater use.

According to a related embodiment of the invention, a vehicle includes an apparatus operable to fire a projectile and a computing machine having an intercoupled processor and hardwired pipeline. The computing machine is operable to aim the apparatus at a target and to cause the aimed apparatus to fire the projectile at the target.

Such a vehicle may be an unmanned vehicle because the computing machine is often significantly smaller than a processor-based range-finding computer.

DETAILED DESCRIPTION

Figure 1:
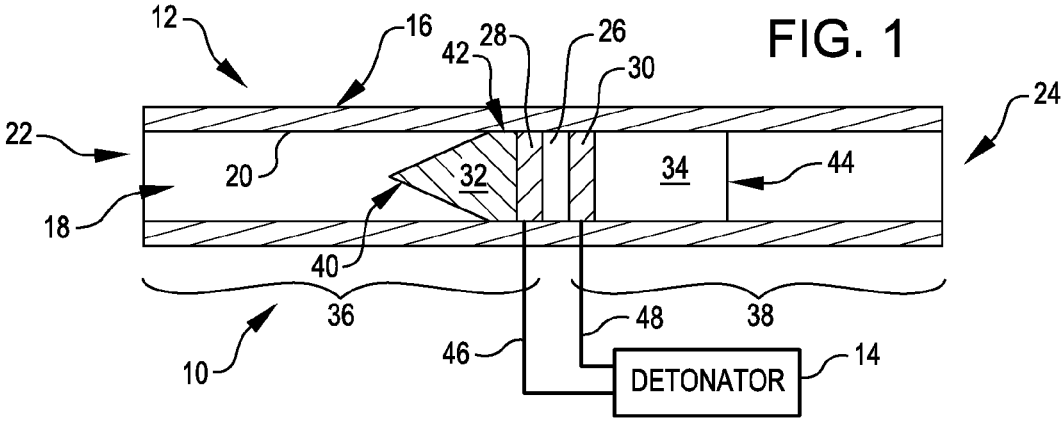
FIG. 1 is a diagram of an unguided-projectile system according to an embodiment of the invention.

FIG. 1 is a diagram of an unguided-projectile system 10, which includes a gun 12 and an electronic detonator 14 according to an embodiment of the invention. As discussed below, the system 10 is suitable for an unmanned vehicle because it is relatively small, recoilless, and relatively inexpensive to maintain, and is suitable for use underwater and in other liquid environments. Moreover, the system 10 fires unguided supercavitating projectiles that have a range substantially greater than conventional unguided projectiles. The system 10 may also include a conventional targeting subsystem (not shown in FIG. 1) for aiming the barrel of the gun 12. Examples of such a targeting subsystem include the targeting subsystems incorporated by unguided-projectile systems manufactured by Metal Storm Ltd. of Brisbane Australia.

The gun 12 includes a cylindrical enclosure, i.e., a barrel 16, which is shown in cross section and which includes chamber 18 having a wall 20 and two open ends 22 and 24. The barrel 16 may be made from steel or other suitable materials, such as those suitable for underwater use.

Inside the chamber 18 of the barrel 16 are disposed a divider 26, propellants 28 and 30, a target-striking supercavitating projectile 32, and a recoil-absorbing projectile 34.

The divider 26 divides the barrel 16 into a striking-projectile section 36 and an absorbing-projectile section 38, is integral with the barrel, and has a thickness that is sufficient to prevent the detonation of the propellants 28 and 30 from deforming the divider. Alternatively, the divider 26 may be attached (e.g., welded) to the barrel 16, or may be made from a material that is different than the material from which the barrel is made. Furthermore, although shown disposed in the middle of the barrel 16, the divider 26 may be disposed at any location within the barrel.

The propellants 28 and 30 may be gunpowder or other propellants that when detonated, respectively propel the projectiles 32 and 34 out of the barrel ends 22 and 24. The propellants 28 and 30 and the projectiles 32 and 34 are designed such that if the detonator 14 simultaneously detonates these propellants, then ideally the effective momentum—effective momentum is discussed below in conjunction with FIG. 2)—of the projectile 32 is the same as that of the projectile 34 such that the barrel 16 experiences little or no recoil. Because the barrel 16 experiences little or no recoil, the gun 12 is often suitable for use on an unmanned vehicle such as that discussed below in conjunction with FIG. 4.

The target-striking projectile 32 is made of metal or another suitable material, and has a tapered, dart-like front end 40, which may reduce drag and facilitate the projectile penetrating a target (not shown in FIG. 1). A back end 42 of the projectile 32 fits snugly against the inner wall 20 of the chamber 18 so as to prevent a fluid, such as water, inside of the chamber from damaging the propellant 28.

Similarly, the recoil-absorbing projectile 34 is made of metal or another suitable material. Because the projectile 34 is not aimed at a target, it is often desired that the recoil-absorbing projectile travel as short a distance as possible to reduce the probability of the projectile causing unintended consequences. Therefore, the projectile 34 has a flat front end 44, which increases drag and limits the distance that the projectile travels. The projectile 32 fits snugly against the inner wall 20 of the chamber 18 so as to prevent a fluid, such as water, inside of the chamber from leaking past the projectile and damaging the propellant 30.

The detonator 14 detonates the propellants 28 and 30 by sending an electrical current to the propellants via wires 46 and 48, respectively, in response to a firing subsystem (not shown in FIG. 1), which may share the same computer as the targeting subsystem (also not shown in FIG. 1). Consequently, the firing mechanism of the gun 12 has no moving parts, thus allowing the gun to have reduced size, complexity, cost, and to be more suitable for underwater use as compared to prior guns. The wires 46 and 48 may extend to the propellants 28 and 30 via respective openings in the barrel wall 18, or may pass current to the propellants in another manner. Furthermore, the detonator 14 may include or be coupled to a battery or other power source (neither shown in FIG. 1) from which the detonator generates the detonation current.

Figure 2:
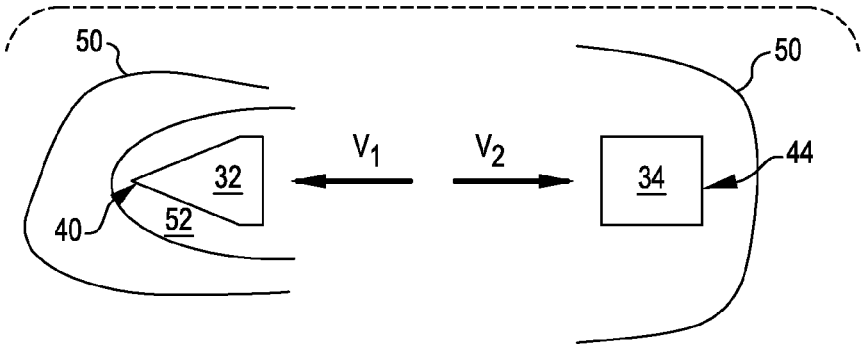
FIG. 2 is a diagram of the target and recoil-absorbing projectiles of FIG. 1 as they travel through a liquid according to an embodiment of the invention.

FIG. 2 is a cross sectional view of the projectiles 32 and 34 of FIG. 1 as they travel through a liquid 50, such as water, according to an embodiment of the invention.

The tapered front end 40 and the size of the propellant 28 (FIG. 1) allow the projectile 32 to achieve a velocity V1, which is sufficient to cavitate a region 52 of the liquid 50 about the projectile. Hence, one may refer to the projectile 32 as a supercavitating projectile. The cavitation region 52 includes a vapor form of the liquid 50, and thus places significantly less drag on the projectile 32 than the liquid 50 would if the cavitation region were not present. Consequently, the cavitation region 52 often allows the projectile 32 to travel significantly farther in the liquid 50 than a projectile about which there is no cavitation region. For example, the cavitation region 52 may allow the projectile 32 to travel one hundred yards or more.

In contrast, the flat front end 44 limits the projectile 34 to achieving only a velocity V2 by causing the liquid to place a relatively large drag on the projectile. Consequently, the flat front end 44 significantly limits the distance that the projectile 34 travels in the liquid 50 as compared to the distance that the projectile 32 travels. But because the function of the projectile 34 is to absorb the recoil that would otherwise be imparted to the barrel 16 by the propellant 28, it is desired to limit the distance that the projectile 34 travels, so as to reduce the chances that this projectile will strike an unintended target or cause another unintended consequence. In one example, the projectile 34 is designed to travel ten or fewer feet in the liquid 50 after the projectile exits the barrel 16. Alternatively, although described as a single, solid mass, the recoil-absorbing projectile 34 may be designed to fragment after the detonator 14 detonates the propellant 30, or formed as a collection of pellets (similar to buckshot), to further reduce the distance traveled by the projectile 34 (or pieces thereof).

Referring to FIGS. 1 and 2, the operation of the gun 12 is described.

First, one loads the propellants 28 and 30 into the chamber 18 of the barrel 16 in a conventional manner.

Next, one loads the projectiles 32 and 34 into the chamber 18.

Then, one installs the loaded barrel 16 into a barrel mount (not shown in FIG. 1), and connects the wires 46 and 48 from the detonator 14 to the propellants 28 and 30.

At some time later, a targeting subsystem (not shown in FIG. 1) acquires a target (also not shown in FIG. 1) and aims the front opening 22 of the chamber 18, and thus aims the projectile 32, at the target.

Next, a firing subsystem (not shown in FIG. 1) detonates the propellants 28 and 30, which respectively propel the projectile 32 toward the target (not shown in FIG. 1) and propel the projectile 34 in a direction opposite to that of the projectile 32. The projectile 32 exits the barrel end 22 and travels toward the target, and the projectile 34 exits the barrel end 24 and travels in the opposite direction, as described above in conjunction with FIG. 2. To reduce or eliminate recoil in the barrel 16, the firing subsystem detonates the propellants 28 and 30 substantially simultaneously. Detonating the propellants 28 and 30 substantially simultaneously allows the force generated on the divider 26 by the detonated propellant 30 to substantially cancel the substantially equal opposing force generated on the divider by the detonated propellant 28. More specifically, to eliminate recoil, $M_{1effective}$ $V_1$ must equal $M_{2effective}$ $V_2$, where $M_{1effective}$ and $V_1$ are the effective mass and the actual velocity of the projectile 32, and where $M_{2effective}$ and $V_2$ are the effective mass and the actual velocity of the projectile 34. The calculation of the effective mass is known but complex, and typically accounts for the water inside of the gun barrel 16 and some amount of the water entrained in the "muzzle blast" that occurs when the propellant detonates. It is theorized that because the effective mass of a ship is about three times the mass of the water that the ship displaces, an upper limit of the effective mass of a projectile, such as the projectiles 32 and 34, exiting a gun barrel is approximately three times the mass of the water that the projectile displaces.

Referring again to FIG. 1, alternative embodiments of the unguided-projectile system 10 are contemplated. For example, the barrel 16 and/or the chamber 18 may be other than cylindrical. Furthermore, the divider 26 may be omitted such that the propellants 28 and 30 contact each other (FIG. 12), or such that the propellants 28 and 30 are combined into a single charge (FIG. 13) that is detonated via a single wire 46 or 48. In addition, although the propellants 28 and 30 are described as detonating entirely within the barrel 16, these propellants may continue detonating outside of the barrel. For example, the projectile 32 may carry the propellant 28, and thus be similar to an unguided rocket or missile. Moreover, the system 10 may include features such as those disclosed in the following U.S. Patents and Patent Publications, which are all incorporated by reference: U.S. Pat. No. 6,889,935 entitled DIRECTIONAL CONTROL OF MISSLES, issued May 10, 2005, to O'Dwyer; U.S. Pat. No. 6,860,187 entitled PROJECTILE LAUNCHING APPARATUS AND METHODS FOR FIRE FIGHTING, issued Mar. 1, 2005, to O'Dwyer; U.S. Pat. No. 6,782,826 entitled DECOY, issued Aug. 31, 2004, to O'Dwyer; U.S. Pat. No. 6,722,252 entitled PROJECTILE FIRING APPARATUS, issued Apr. 20, 2004, to O'Dwyer; U.S. Pat. No. 6,715,393 entitled BARREL ASSEMBLY FOR FIREARMS, issued Apr. 6, 2004, to O'Dwyer; U.S. Pat. No. 6,701,818 entitled METHOD FOR SEISMIC EXPLORATION OF A REMOTE SITE, issued Mar. 9, 2004, to O'Dwyer; U.S. Pat. No. 6,557,449 entitled FIREARMS, issued May 6, 2003, to O'Dwyer; U.S. Pat. No. 6,543,174 entitled BARREL ASSEMBLY WITH OVER-PRESSURE RELIEF, issued Apr. 8, 2003, to O'Dwyer; U.S. Pat. No. 6,510,643 entitled BARREL ASSEMBLY WITH AXIALLY STACKED PROJECTILES, issued Jan. 28, 2003, to O'Dwyer; U.S. Pat. No. 6,477,801 entitled FIREARMS SECURITY, issued Nov. 12, 2002, to O'Dwyer; U.S. Pat. No. 6,431,076 entitled FIREARMS, issued Aug. 13, 2002, to O'Dwyer; U.S. Pat. No. 6,343,553 entitled FIREARMS, issued Feb. 5, 2002, to O'Dwyer; U.S. Pat. No. 6,301,819 entitled BARREL ASSEMBLY WITH AXIALLY STACKED PROJECTILES, issued Oct. 16, 2001; to O'Dwyer; U.S. Pat. No. 6,223,642 entitled CANNON FOR AXIALLY FED ROUNDS WITH BREECHED ROUND SEALING BREECH CHAMBER, issued May 1, 2001, to O'Dwyer; U.S. Pat. No. 6,138,395 entitled BARREL ASSEMBLY WITH AXIALLY STACKED PROJECTILES, issued Oct. 31, 2000, to O'Dwyer; U.S. Pat. No. 6,123,007 entitled BARREL ASSEMBLY, issued Sep. 26, 2000, to O'Dwyer; Patent Publication Nos.: US 2005/0022657 entitled PROJECTILE LAUNCHING APPARATUS, published Feb. 3, 2005, to O'Dwyer; US 2004/0237762 entitled SET DEFENSE MEANS, published Dec. 2, 2004, to O'Dwyer; US 2002/0157526 entitled BARREL ASSEMBLY WITH OVER-PRESSURE RELIEF, published Oct. 31, 2002, to O'Dwyer; and US 2002/0152918 entitled FIREARMS, published Oct. 24, 2002, to O'Dwyer.

Figure 3:
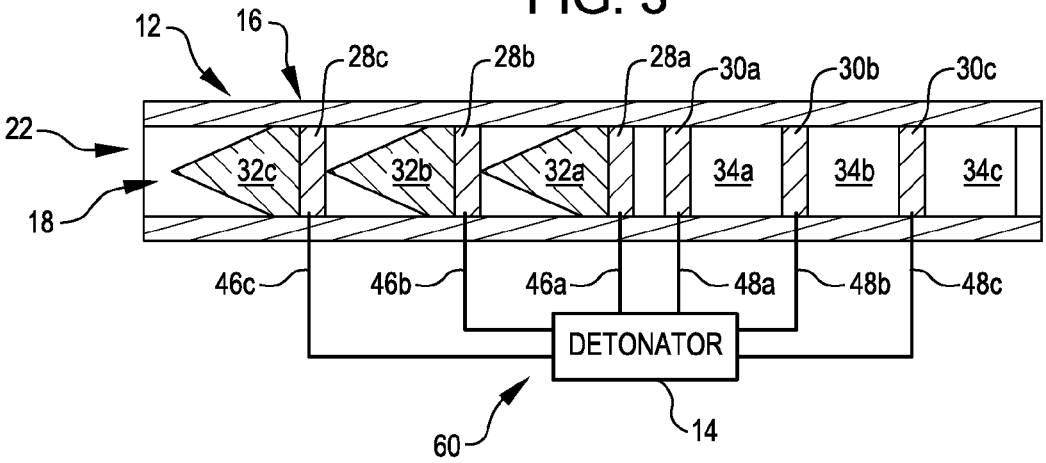
FIG. 3 is a diagram of an unguided-projectile system that can hold multiple rounds of projectiles according to an embodiment of the invention.

FIG. 3 is a diagram of an unguided-projectile system 60 according to another embodiment of the invention, where like components of the system 60 are referenced with the same number as for the system 10 in FIG. 1. The system 60 is similar to the system 10 of FIG. 1, except that the chamber 18 of the barrel 16 holds multiple rounds (here three rounds) of supercavitating projectiles 32*a*-32*c* and 34*a*-34*c* and corresponding propellants 28*a*-28*c* and 30*a*-30*c*. Holding multiple rounds of projectiles 30 and 32 increases the fire power of the system 60, and may reduce the frequency at which one reloads the gun 12.

Referring to FIG. 3, the operation of the gun 12 of the system 60 is described according to an embodiment of the invention.

First, one loads the propellants 28*a* and 30*a* into the chamber 18 of the barrel 16 in a conventional manner.

Next, one loads the projectiles 32*a* and 34*a* into the chamber 18.

Then, one loads the propellants 28*b* and 30*b* and the projectiles 32*b* and 34*b* into the chamber 18, followed by the propellants 28*c* and 30*c* and the projectiles 32*c* and 34*c*.

Then, one installs the loaded barrel 16 into a barrel mount (not shown in FIG. 3), and connects the wires 46*a*-46*c* and 48*a*-48*c* from the detonator 14 to the propellants 28*a*-28*c* and 30*a*-30*c*, respectively.

At some time later, a targeting subsystem (not shown in FIG. 3) acquires a target (also not shown in FIG. 3) and aims the front opening 22 of the chamber 18, and thus aims the supercavitating projectile 32*c*, at the target.

Next, a firing subsystem (not shown in FIG. 3) detonates the propellants 28*c* and 30*c*, which respectively propel the projectile 32*c* toward the target (not shown in FIG. 3) and the projectile 34*c* in a direction opposite to that of the projectile 32*c*. To reduce or eliminate recoil in the barrel 16, the firing subsystem detonates the propellants 28*c* and 30*c* substantially simultaneously in a manner similar to that described above in conjunction with FIGS. 1-2.

Then, the targeting subsystem (not shown in FIG. 3) reacquires the previous target (if necessary) or a new target (also not shown in FIG. 3), and re-aims the front opening 22 of the chamber 18 at the previous target or aims the front opening at the new target.

Next, the firing subsystem (not shown in FIG. 3) detonates the propellants 28*b* and 30*b*, which respectively propel the projectile 32*b* toward the previous target or new target (neither shown in FIG. 3) and the projectile 34*b* in a direction opposite to that of the projectile 32*b*. To reduce or eliminate recoil in the barrel 16, the firing subsystem detonates the propellants 28*b* and 30*b* substantially simultaneously as discussed above for the propellants 28*c* and 30*c*.

Then, the targeting subsystem (not shown in FIG. 3) reacquires the previous target (if necessary) or a new target (also not shown in FIG. 3), and re-aims the front opening 22 of the chamber 18 at the previous target or aims the front opening at the new target.

Next, the firing subsystem (not shown in FIG. 3) detonates the propellants 28*a* and 30*a*, which respectively propel the projectile 32*a* toward the previous target or new target (neither shown in FIG. 3) and the projectile 34*a* in a direction opposite to that of the projectile 32*a*. To reduce or eliminate recoil in the barrel 16, the firing subsystem detonates the propellants 28*a* and 30*a* substantially simultaneously as discussed above for the propellants 28*c* and 30*c*.

Referring again to FIG. 3, alternative embodiments of the system 60 are contemplated. For example, alternative embodiments similar to those discussed above for the system 10 of FIG. 1 are contemplated. Furthermore, the chamber 18 may hold two or more than three rounds of the projectiles 32 and 34. In addition, one may load the chamber with different types of projectiles 32 and 34, and different types or sizes of the propellants 28 and 30. But in one embodiment, corresponding groupings of projectiles 32 and 34 (e.g., projectiles 32*b* and 34*b*) and propellants 28 and 30 (e.g., propellants 28*b* and 30*b*) are designed such that when the propellants are detonated substantially simultaneously, the barrel 16 experiences little or no recoil.

Figure 4:
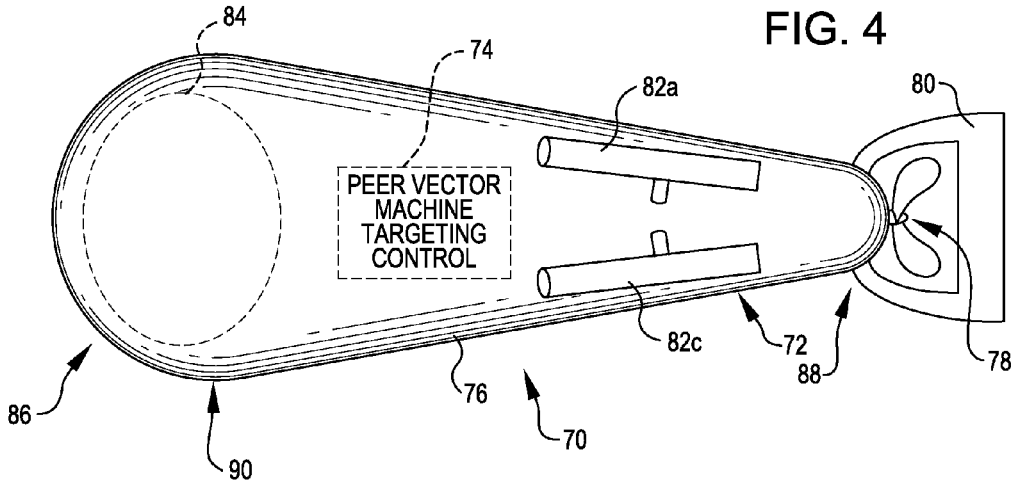
FIG. 4 is a diagram of an unmanned vehicle that carries an unguided-projectile system according to an embodiment of the invention.

FIG. 4 is a view of an unmanned underwater vehicle 70, which includes an unguided-projectile system 72 and a peer-vector computing machine 74 according to an embodiment of the invention. Because the vehicle 70 includes an unguided-projectile system, the vehicle can often seek, acquire, and disable or destroy a target without destroying itself or the unguided-projectile system 72. Consequently, the system 72 may render the vehicle 70 less costly over time than a fleet of guided-projectile systems, such as torpedoes, that typically destroy themselves while disabling or destroying targets.

The vehicle 70 is shaped like a torpedo, and, in addition to the system 72 and computing machine 74, includes a hull 76, a propulsion device (here a propeller 78) and a rudder 80. Although omitted from FIG. 4, the vehicle 70 may also include a motor for driving the propeller 78, a steering mechanism for moving the rudder 80, a buoyancy system for setting the vehicle's depth, a guidance system that is self contained and/or communicates with a remote command center such as on board the ship that launched the vehicle, a power-supply system, or other conventional components and systems. The computing machine 74 may partially or fully control some or all of the above-described components and systems.

The unguided-projectile system 72 includes guns 82*a*-82*n* (only guns 82*a*-82*c* shown in FIG. 4) mounted to the outside of the hull 76 of the vehicle 70. Each of the guns 82 may be the same as or similar to the recoilless single-round gun 12 of FIG. 1 or the recoilless multiple-round gun 12 of FIG. 3. Although the guns 82 are shown as being stationary relative to the hull 76, the guns may be mounted with mechanical arms (not shown in FIG. 4) or another mechanism that can move the guns relative to the hull.

The unguided-projectile system 72 also includes a sonar array 84 for generating and receiving signals that the computing machine 74 processes to detect and acquire a target (not shown in FIG. 4). Although the array 84 is shown as including a single section mounted to a nose 86 of the hull 76, the array may be mounted on another portion of the hull, or may include multiple sections (not shown) that are each mounted to a respective portion of the hull. For example, the array 84 may include a section mounted to the nose 86 of the hull 76, a section mounted to a rear 88 of the hull, and four sections each mounted equidistantly around a front portion 90 of the hull. Furthermore, the sonar array 84 may be separate and distinct from a sonar array that is part of the vehicle's guidance system (not shown in FIG. 4), or the projectile system 72 and the vehicle's guidance system may share the array 84.

Figure 5:
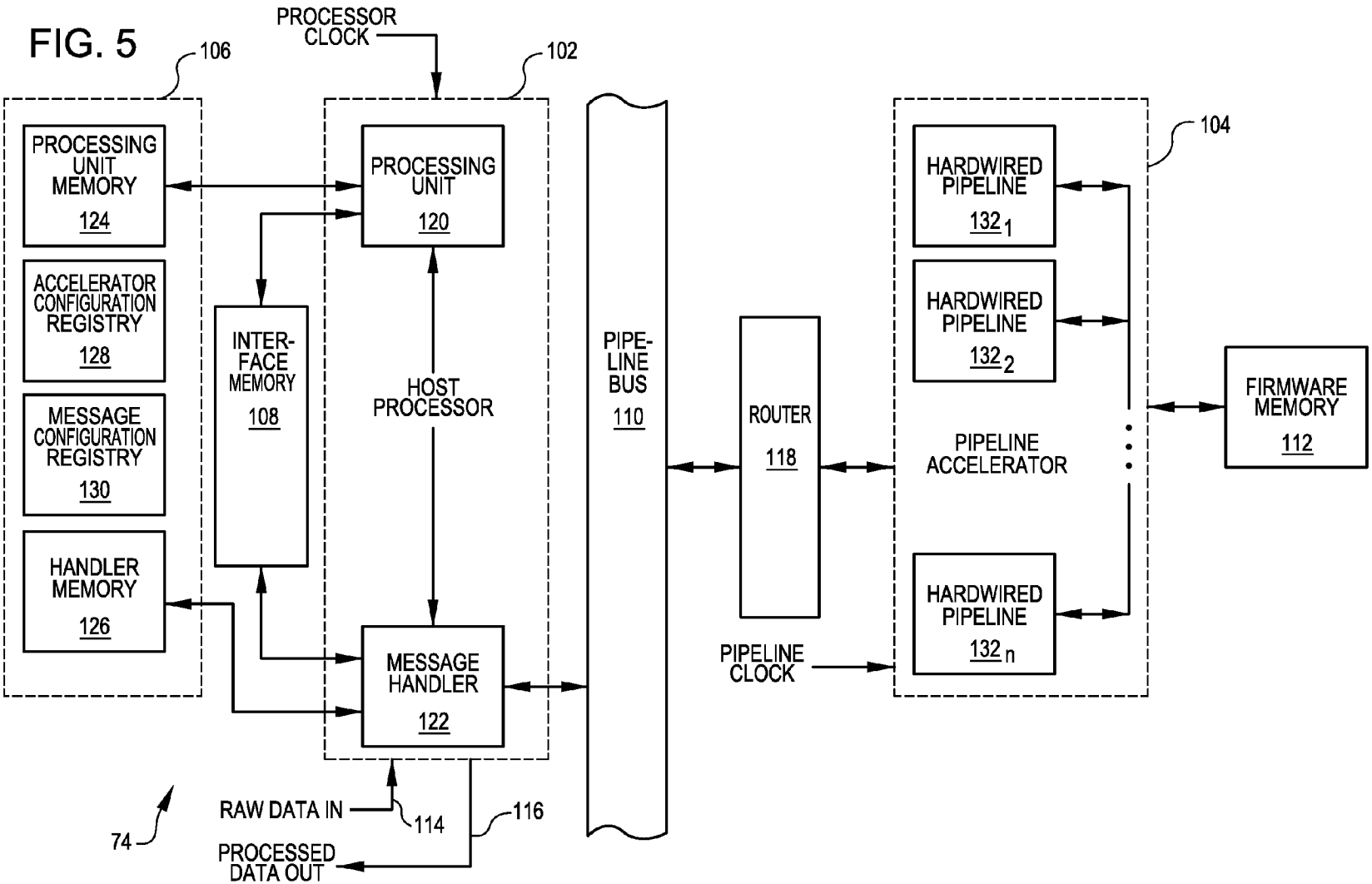
FIG. 5 is a schematic block diagram of the computing machine of FIG. 4 according to an embodiment of the invention.

The peer-vector computing machine 74, which is further described below in conjunction with FIG. 5, is powerful enough to provide the processing power that the projectile system 72, the guidance system (not shown in FIG. 4), and the other systems (not shown in FIG. 4) of the unmanned vehicle 70 require, yet is sufficiently small and energy efficient to fit within the hull 76 and run off of the vehicle's power-supply system (not shown in FIG. 4), which may be a battery. As an alternative to a single peer-vector computing machine 74 servicing both the projectile system 72 and the guidance and other systems of the vehicle 70, the vehicle may include multiple peer-vector computing machines: one dedicated to the projectile system, and the other(s) dedicated to the guidance and other systems or, the vehicle 70 may include a combination of one or more peer-vector computer machines and one or more conventional processor-based computer machines.

Alternate embodiments of the vehicle 70 are contemplated. For example, although the guns 82 are shown pointed in the same direction, the guns 82 may point in different directions. That is, some guns 82 may point toward the nose 86 of the vehicle 70, and others may point to the rear 88 of the vehicle. Moreover, although the vehicle 70 is described as suited for underwater operation, similar vehicles may be designed for operation in other environments, such as ground, air, and outer space. In addition, the vehicle 70 may have a shape other than that of a torpedo.

FIG. 5 is a schematic block diagram of the peer-vector computing machine 74 of FIG. 4 according to an embodiment of the invention. In addition to a host processor 102, the peer-vector machine 74 includes a pipeline accelerator 104, which is operable to process at least a portion of the data processed by the machine 74. Therefore, the host-processor 102 and the accelerator 104 are "peers" that can transfer data messages back and forth. Because the accelerator 104 includes hardwired logic circuits instantiated on one or more programmable-logic integrated circuits (PLICs), it executes few, if any, program instructions in the traditional sense (e.g., fetch an instruction, load the fetched instruction into an instruction register), and thus typically performs mathematically intensive operations on data significantly faster than a bank of instruction-executing computer processors can for a given clock frequency. Consequently, by combining the decision-making ability of the processor 102 and the number-crunching ability of the accelerator 104, the machine 74 has the same abilities as, but can often process data faster than, a conventional processor-based computing machine. Furthermore, as discussed below and in U.S. Patent Publication No.

2004/0136241, which is incorporated by reference, providing the accelerator 104 with a communication interface that is compatible with the interface of the host processor 102 facilitates the design and modification of the machine 74, particularly where the communication interface is an industry standard. In addition, for a given data-processing power, the computing machine 74 is often smaller and more energy efficient than a processor-based computing machine. Moreover, the machine 74 may also provide other advantages as described in the following other U.S. Patents and Patent Publications, which are incorporated by reference: publication Nos. 2004/0133763; 2004/0181621; 2004/0170070; 2004/0130927; and US 2006/0087450 entitled REMOTE SENSOR PROCESSING SYSTEM AND METHOD, published Apr. 27, 2006, to Schulz; US 2006/0230377 entitled COMPUTER-BASED TOOL AND METHOD FOR DESIGNING AN ELECTRONIC CIRCUIT AND RELATED SYSTEM, published Oct. 12, 2006, to Rapp; US 2006/0149920 entitled OBJECT ORIENTED MISSION FRAMEWORK AND SYSTEM AND METHOD, published Jul. 6, 2006, to Rapp; US 2006/0101250 entitled CONFIGURABLE COMPUTING MACHINE AND RELATED SYSTEMS AND METHODS, published May 11, 2006, to Rapp; US 2006/0101307 entitled RECONFIGURABLE COMPUTING MACHINE AND RELATED SYSTEMS AND METHODS, published May 11, 2006, to Rapp; U.S. Pat. No. 7,487,302 entitled SERVICE LAYER ARCHITECTURE FOR MEMORY ACCESS SYSTEM AND METHOD, issued Feb. 3, 2009 to Gouldey; US 2006/0085781 entitled LIBRARY FOR COMPUTER-BASED TOOL AND RELATED SYSTEM AND METHOD, published Apr. 20, 2006, to Rapp; and US 2006/0101253 entitled COMPUTING MACHINE WITH REDUNDANCY AND RELATED SYSTEM AND METHODS, published May 11, 2006 to Rapp.

Still referring to FIG. 5, in addition to the host processor 102 and the pipeline accelerator 104, the peer-vector computing machine 74 includes a processor memory 106, an interface memory 108, a bus 110, a firmware memory 112, an optional raw-data input port 114, an optional processed-data output port 116, and an optional router 118.

The host processor 102 includes a processing unit 120 and a message handler 122, and the processor memory 106 includes a processing-unit memory 124 and a handler memory 126, which respectively serve as both program and working memories for the processor unit and the message handler. The processor memory 124 also includes an accelerator-configuration registry 128 and a message-configuration registry 130, which store respective configuration data that allow the host processor 102 to configure the functioning of the accelerator 104 and the structure of the messages that the message handler 122 sends and receives.

The pipeline accelerator 104 includes at least one PLIC, such as a field-programmable gate array (FPGA), on which are disposed hardwired pipelines $\mathbf{132}_1$-$\mathbf{132}_n$, which process respective data while executing few, if any, program instructions in the traditional sense. The firmware memory 112 stores the configuration firmware for the PLIC(s) of the accelerator 104. If the accelerator 104 is disposed on multiple PLICs, these PLICs and their respective firmware memories may be disposed on multiple circuit boards that are often called daughter cards or pipeline units. The accelerator 104 and pipeline units are discussed further in previously incorporated U.S. Patent Publication Nos. 2004/0136241, 2004/0181621, and 2004/0130927.

Generally, in one mode of operation of the peer-vector computing machine 74, the pipelined accelerator 104 receives data from one or more software applications running on the host processor 102, processes this data in a pipelined fashion with one or more logic circuits that execute one or more mathematical algorithms, and then returns the resulting data to the application(s). As stated above, because the logic circuits execute few if any software instructions in the traditional sense, they often process data one or more orders of magnitude faster than the host processor 102. Furthermore, because the logic circuits are instantiated on one or more PLICs, one can modify these circuits merely by modifying the firmware stored in the memory 112; that is, one need not modify the hardware components of the accelerator 104 or the interconnections between these components. The operation of the peer-vector machine 74 is further discussed in previously incorporated U.S. Patent Publication No. 2004/0133763, the functional topology and operation of the host processor 102 is further discussed in previously incorporated U.S. Patent Publication No. 2004/0181621, and the topology and operation of the accelerator 104 is further discussed in previously incorporated U.S. Patent Publication No. 2004/0136241.

Figure 6:
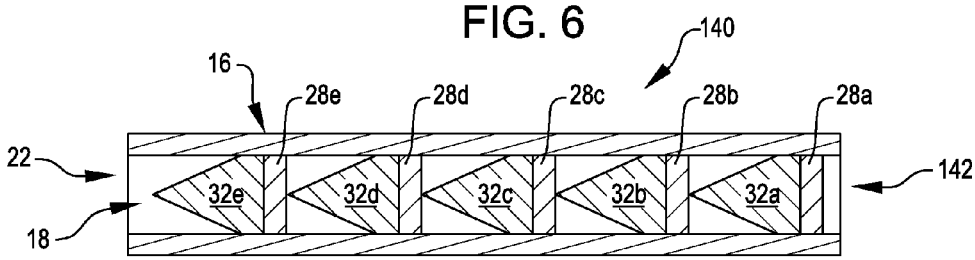
FIG. 6 is a block diagram of the unguided-projectile system of FIG. 4 according to another embodiment of the invention.

FIG. 6 is a cut-away side view of a gun 140, which can replace one or more of the guns 82 on the vehicle 70 of FIG. 4 according to an embodiment of the invention. The gun 140 is similar to the gun 12 of FIG. 3 except that the gun 140 is not recoilless. But for given barrel and supercavitating-projectile lengths, the gun 140 can hold more supercavitating projectiles than the gun 12 of FIG. 3.

Like the gun 12 of FIG. 3, the gun 140 includes a barrel 16 having a chamber 18 with an open end 22 through which one may load supercavitating projectiles 32*a*-32*e* and propellants 28*a*-28*e* into the chamber. But unlike the gun 12 of FIG. 3, the gun 140 includes a closed end 142. Therefore, when a propellant 28 detonates, it causes the barrel 16 to recoil in a direction opposite to that in which the fired projectile 32 travels.

To absorb the recoil that occurs when the gun 140 is fired, the gun may be mounted to the hull 76 of the vehicle 70 (FIG. 4) using a conventional recoil-absorbing technique.

Alternatively, if the vehicle 70 (FIG. 4) includes multiple guns 140, these guns may be mounted and fired to lessen the recoil affect. For example, if two guns 140 pointing in the same direction are mounted on opposite sides (180° apart) of the hull 76 and fire projectiles 32 substantially simultaneously, then although the recoil will force the vehicle 70 substantially straight backward (assuming the projectiles 32 and propellants are my balanced per above), the guns 140 (and possible other guns on the vehicle 70) will remain aimed at the target (not shown in FIG. 4 or 6). In addition, the propeller 78 or other propulsion unit (not shown in FIG. 4 or 6) may generate a force that partially or fully counteracts the recoil, thus limiting or eliminating the backward movement of the vehicle 70. Or, if two guns 140 are mounted on a same side of the hull 70 but are pointed in opposite directions, then the vehicle 70 may experience little or no recoil.

Still referring to FIG. 6, the gun 140 may include features that are similar to features of guns manufactured by Metal Storm, Ltd., of Brisbane, Australia.

Figure 7:
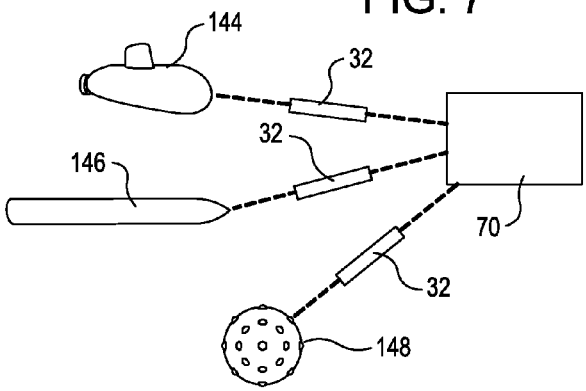
FIG. 7 is a diagram of the unmanned vehicle of FIG. 4 destroying underwater targets with unguided projectiles according to an embodiment of the invention.

FIG. 7 is a diagram showing the vehicle 70 of FIG. 4 firing supercavitating projectiles 32 at multiple targets, including an enemy submarine 144, an incoming torpedo 146 and a mine 148, according to an embodiment of the invention.

Referring to FIGS. 1-2, 4, and 7, the operation of the vehicle 70 is described.

First, one loads the supercavitating projectiles 32 and propellants 28 into the guns 82. If the guns 82 are recoilless like the guns 12 of FIGS. 1 and 3, then he also loads the recoil-absorbing projectiles 34 and propellants 30 into the guns 82.

Next, one prepares the vehicle 70 for launching.

Then, one launches the vehicle 70, for example, from a conventional torpedo tube on a submarine.

Next, the projectile system 72 searches for a target, for example, the mine 148. For example, the peer-vector computing machine 74 causes the sonar array 84 to transmit sonar signals, and to receive portions of these signals reflected from objects in the paths of the transmitted signals. The computing machine 74 then processes these reflected signals using one or more conventional algorithms to determine if one or more of the objects are targets. Alternatively, other sonar techniques, such as bistatic active or passive techniques, may be used. Or, laser radar (LADAR) may be used. The computing machine 74 continues this process until it identifies a target. Alternatively, a human operator on the launching ship (not shown in FIG. 7) may monitor this data to assist in determining which, if any, of these objects is a target. The vehicle 70 may communicate with the launching ship (via a cable that composes a part of a tether, via the sonar array 86, or via any other means).

Then, the peer vector computing machine 74 controls the propeller 78 and the rudder 80 so as to maneuver the vehicle 70 into range of the target.

Next, the peer-vector computing machine 74 aims one or more of the guns 82 at the target. If the guns 82 are immovable relative to the hull 76, then the computing machine 74 controls the propeller 78 and rudder 80 so as to maneuver the vehicle 70 into a position in which one or more of the guns are aimed at the target. Alternatively, if the guns 82 are moveable relative to the hull 76, then the computing machine 74 may cause only the guns to move, or may both move the guns and maneuver the vehicle 70 into a desired position. Furthermore, if the target is moving, then the computing machine 74 may cause the one or more guns 82 and/or the vehicle 70 to move so as to track the movement of the target.

Then, the peer-vector computing machine 74 determines the number of projectiles 32, the firing sequence of the guns 82 (if multiple guns are to be fired), and the time between firing each of the projectiles needed for the desired affect (e.g., disable, destroy) on the target. For example, for a single mine 148, the computing machine 74 may determine that two projectiles 32 fired one second apart are sufficient for ensuring that the mine is destroyed. The computing machine 74 may make this determination using one or more conventional algorithms. More specifically, because the cavitation region 52 may behave somewhat unpredictably and thus cause the projectile 32 to veer from its intended trajectory (particularly for a projectile 32 fired into the wake of a previously fired projectile) and because the aiming may be somewhat inaccurate (particularly as to the target's depth), the computing machine 74 may fire multiple projectiles 32 to increase the probability that at least one projectile hits the target. For example, although a hit by a single projectile 32 may be sufficient to destroy a mine 148, the computing machine 74 may fire multiple projectiles to increase to a predetermined level the probability that at least one projectile actually hits the mine. To make this determination, the computer machine 74 executes an algorithm that accounts for, e.g. the level of error in the aiming of the gun(s) and the distance from the vehicle 70 to the target.

Next, the peer-vector computing machine 74 causes the detonator 14 to fire the one or more projectiles from the one or more guns 82 in the determined sequence and at the determined time interval(s).

Then, the peer-vector computing machine 74 processes sonar signals received by the array 84 to determine if the target is disabled/destroyed. Alternatively, other sonar techniques or target-detecting techniques (e.g. LADAR) may be used as discussed above. Or, because determining whether a target is disabled or destroyed may be a complex process, a human operator may make this determination based on the available data and/or with the aid of the computing machine 74.

If the peer-vector computing machine 74 determines that the target is not disabled/destroyed, then the machine 74 re-aims (if necessary) and refires the one or more guns 82 until the target is destroyed.

If, however, the peer-vector computing machine 74 determines that the target is disabled/destroyed, then the computing machine searches for another target, or causes the vehicle 70 to travel to a predetermined location, such as the launch ship or site. For example, if the vehicle 70 is to destroy multiple incoming torpedoes, then after the first torpedo is destroyed, the peer-vector computing machine 74 searches for and finds the next torpedo, aims the one or more of the guns 82 and/or maneuvers the vehicle 70 into position, and causes the detonator 14 to fire one or more projectiles 32 at the next torpedo until it is destroyed. The computing machine 74 continues in this manner until all of the incoming torpedoes are destroyed.

Still referring to FIGS. 1-2, 4, and 7, alternative embodiments of the operation of the vehicle 70 are contemplated. For example, a remote system, such as a computer system on board the ship that launched the vehicle 70, may perform the target-detecting function, the target-aiming function, the projectile-firing function, or any other function described above as being performed by the peer-vector computing machine 74. In an extreme example, the peer-vector computing machine 74 may be omitted, and the remote system (which may itself include a peer-vector computing machine) may fully control the operation of the vehicle 70. The remote system may communicate with the vehicle 70 via a fiber-optic or other cable that is part of a line that tethers the vehicle to the launching ship, or with sonar signals via the sonar array 84. Furthermore, as discussed above, the peer-vector computing machine 74 (or the remote system) may cause one or more of the guns 82 to fire a spread of projectiles 32 to insure that at least one projectile hits the target. The computing machine 74 may generate such a spread by firing guns 82 on multiple sides of the vehicle 70, or by moving the guns 82 slightly in between the firing of multiple rounds of the projectiles 32.

FIGS. 8-11 illustrate an application of the vehicle 70 according to an embodiment of the invention. In this embodiment, a ship, such as a "friendly" submarine 150, launches the vehicle 70 together with a torpedo 152, and the vehicle assists the torpedo in disabling or destroying a target, such as an enemy submarine 154, which is located in a littoral environment (i.e., near shore and/or in shallow-water). By using the vehicle 70 instead of or in addition to the friendly submarine 150 to determine the location of the enemy submarine 154, the friendly submarine is less likely to inadvertently disclose its location.

Figure 8:
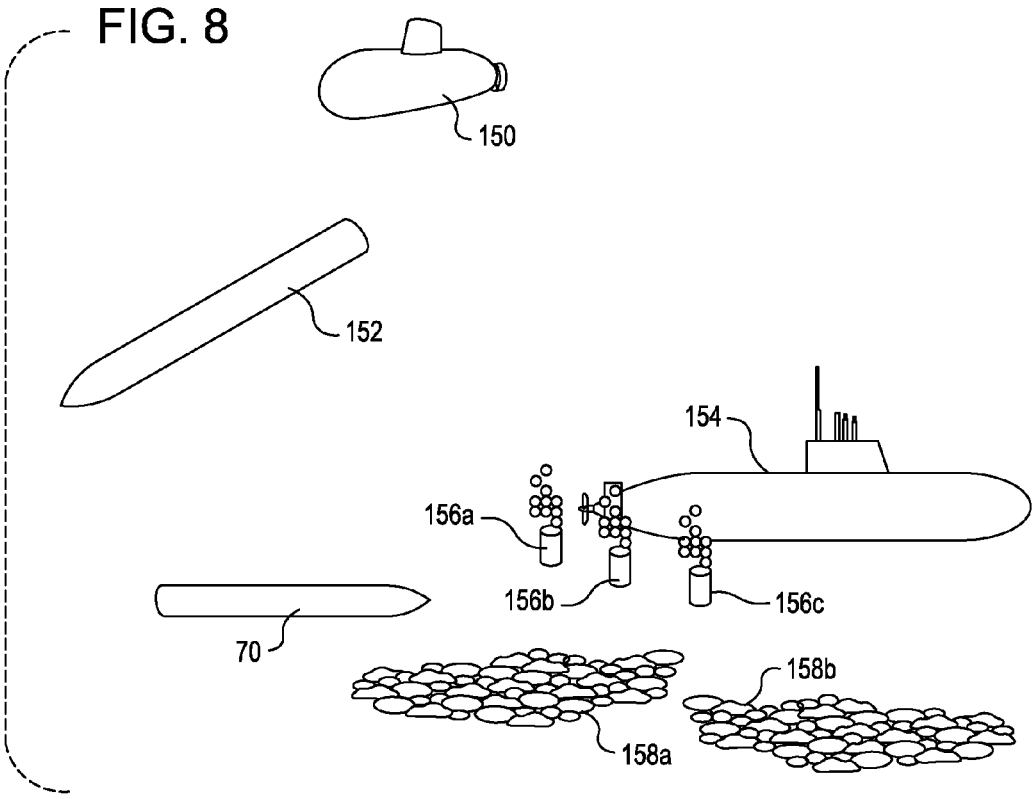
FIGS. 8-11 illustrate an application of the unmanned vehicle of FIG. 4 according to an embodiment of the invention.

Referring to FIGS. 4 and 8, the friendly submarine 150 detects the enemy submarine 154.

Next, the friendly submarine 150 launches the vehicle 70, and at the same time or at some time thereafter, launches the torpedo 152. In response to the friendly submarine 150 launching the vehicle 70 and/or the torpedo 152, the enemy submarine 154 launches one or more counter measures, here three counter measures **156*a*-156*c*, to interfere with sonar signals used to guide the torpedo 152 such that the torpedo misses, and thus does not disable or destroy, the enemy submarine. For example, the counter measures 156 may emit "noise" that interferes with or otherwise masks sonar signals reflected from the enemy submarine 154**.

Then, the peer-vector computing machine 74 causes the sonar array 84 to transmit a spread of sonar signals, and, according to one or more conventional algorithms, processes the reflected portions of these signals received by the array to map objects and formations in the water and on the sea floor and to detect the counter measures 156. For example, the computing machine 74 maps rock beds 158*a* and 158*b* on the sea floor.

Next, the peer-vector computing machine 74 transmits the sea-floor map and the positions of the counter measures 156 to the torpedo 152, and the guidance system (not shown in FIGS. 8-11) of the torpedo uses this information to distinguish the enemy submarine 154 and the countermeasures 156 from each other and from any objects or formations, such as the rock beds 158*b* or 158*a*. The computing machine 74 may transmit this information directly to the torpedo 152 via the sonar array 84 and the torpedo's sonar array (not shown in FIGS. 8-11), or indirectly via the friendly submarine 150. The computing machine 74 may transmit this and other information to the submarine 150 via the sonar array 84 and the friendly submarine's sonar array (not shown in FIGS. 8-11), or via a fiber optic or other cable that forms part of a line (not shown in FIGS. 8-11) that tethers the vehicle 70 to the friendly submarine.

Figure 9:
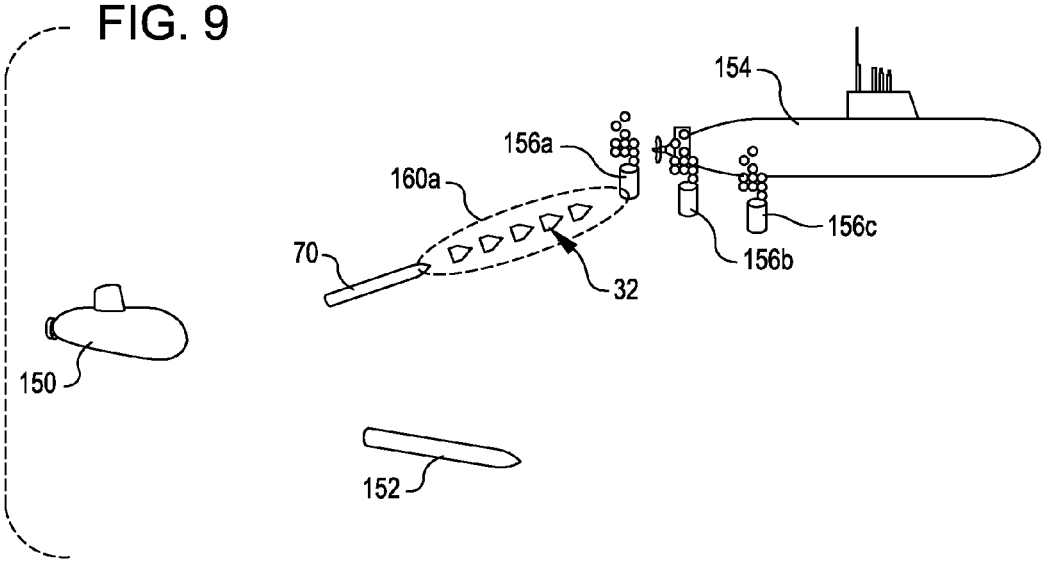

Referring to FIGS. 4 and 9, the peer-vector computing machine 74 then aims one or more of the guns 82 at the first counter measure 156*a*, and fires a volley of projectiles 32 to destroy the first counter measure. The computing machine 74 may cause the sonar array 84 to emit ultra-high-frequency sonar signals and to receive the reflections of these signals from the first counter measure 156*a* to more precisely locate the first counter measure, and thus to more precisely aim the one or more of the guns 82. Furthermore, the computing machine 74 continues to map the region and to provide this information to the torpedo 152. Although the trail of bubbles and other noise (not shown in FIG. 4 or 8-11) generated by the supercavitating projectiles 32 may add to the interference generated by the first counter measure 156*a* (and perhaps add to the interference generated by the second and/or third counter measures 156*b* and 156*c*) in a region 160*a*, this trail will typically dissipate quickly enough such that after the destruction of one or more of the counter measures 156, the guidance system of the torpedo 152 can more easily determine the location of the enemy submarine 154

Figure 10:
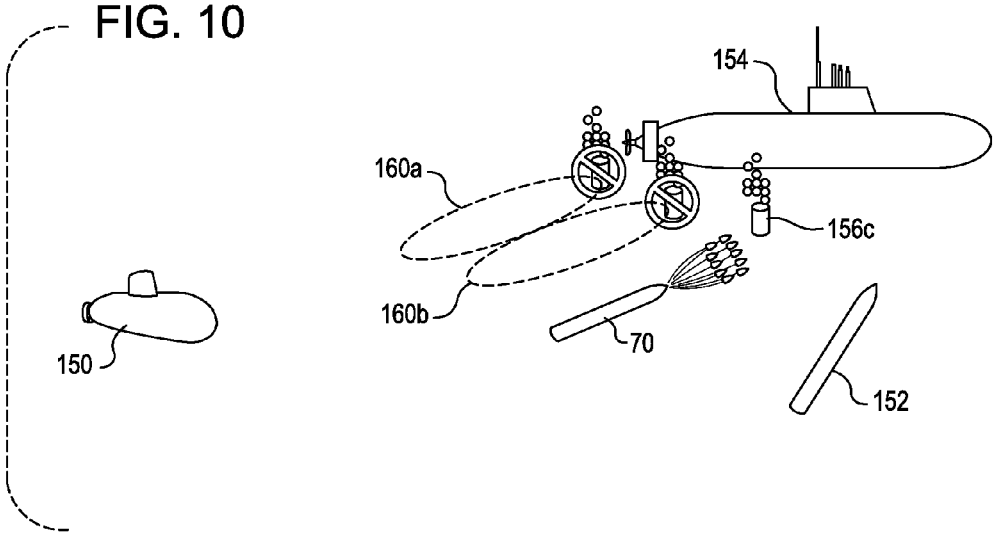

Referring to FIGS. 4 and 10, the peer-vector computing machine 74 next aims one or more of the guns 82 at the second counter measure 156*b*, fires a volley of projectiles 32 to destroy the second counter measure and to generate a degraded region 160*b*, and continues to map the region and to provide this information to the torpedo 152 per the preceding paragraph.

Figure 11:
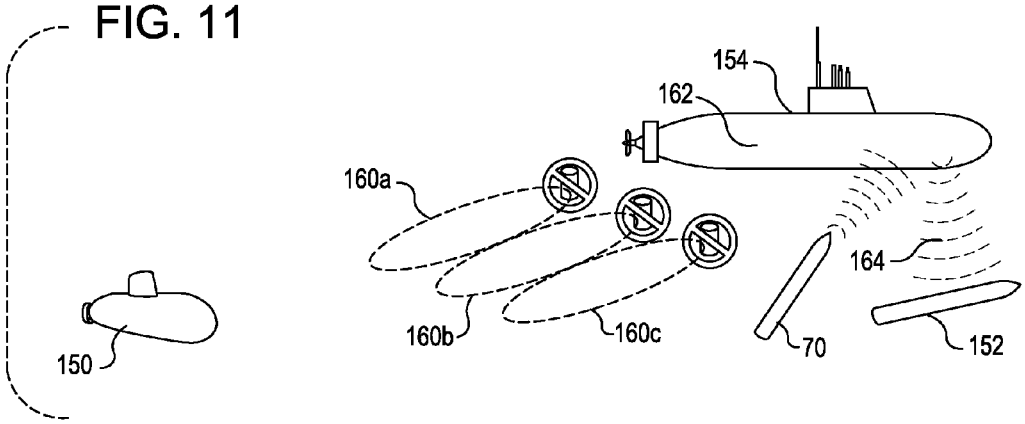

Referring to FIGS. 4 and 11, the peer-vector computing machine 74 then aims one or more of the guns 82 at the third counter measure 156*c*, fires a volley of projectiles 32 to destroy the third counter measure and to generate a degraded region 160*c*, and continues to map the area and to provide this information to the torpedo 152 per the preceding two paragraphs above.

Next, the peer-vector computing machine 74 causes the sonar array 84 to emit sonar signals 162 toward the enemy submarine 154, and the sonar array (not shown in FIGS. 8-11) of the torpedo 152 receives and processes conventional bistatic active echoes reflected by the enemy submarine. The torpedo's guidance system (not shown in FIGS. 8-11) processes these reflections to identify low Doppler target echoes 164, and maneuvers the torpedo 152 toward and into the enemy submarine 154 based on these echoes. Finding low Doppler target echoes is suitable in this situation because the enemy submarine 154 is either stationary or moving slowly because of the littoral environment. More specifically, in a littoral environment, the torpedo's guidance system (which may include a peer-vector machine) executes a classification algorithm to distinguish the enemy submarine 154 (which here is relatively slow moving) from non-target objects such as fish and rocks, so that the torpedo is not "wasted" on one of these non-target objects. The classification algorithm may use the described Doppler analysis as one of its components.

Referring to FIGS. 4 and 8-11, alternate embodiments of the above-described application of the vehicle 70 are contemplated. For example, the friendly submarine 150 can remotely control some or all of the operations of the vehicle 70 and/or the torpedo 152. Furthermore, although the use of certain types of sonar techniques are described for mapping, detecting, and aiming, other sonar techniques or non-sonar techniques such as LADAR may be used for one or more of these tasks.

Figure 12:
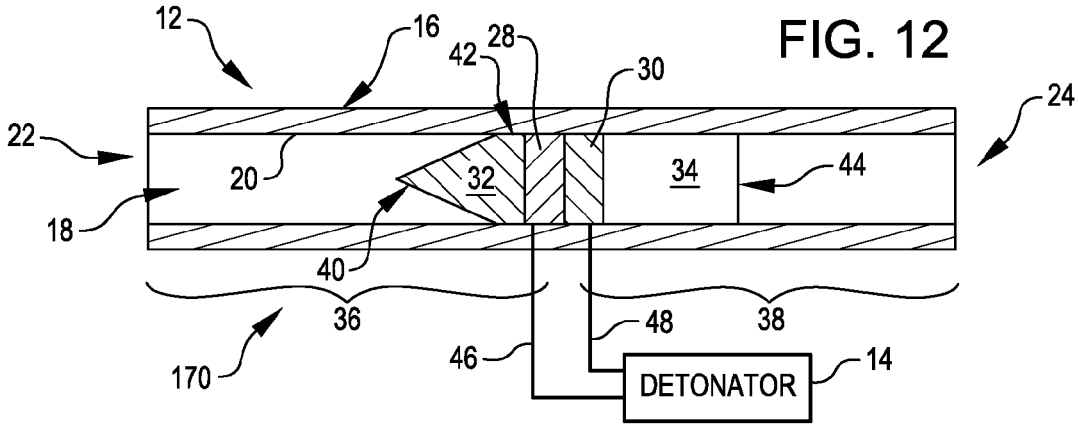
FIG. 12 is a diagram of an unguided-projectile system according to another embodiment of the invention.

FIG. 12 is a diagram of an unguided-projectile system 170 according to an embodiment of the invention. The system 170 is similar to the system 10 of FIG. 1 except that the divider 26 (FIG. 1) is omitted and the propellants 28 and 30 contact each other.

Figure 13:
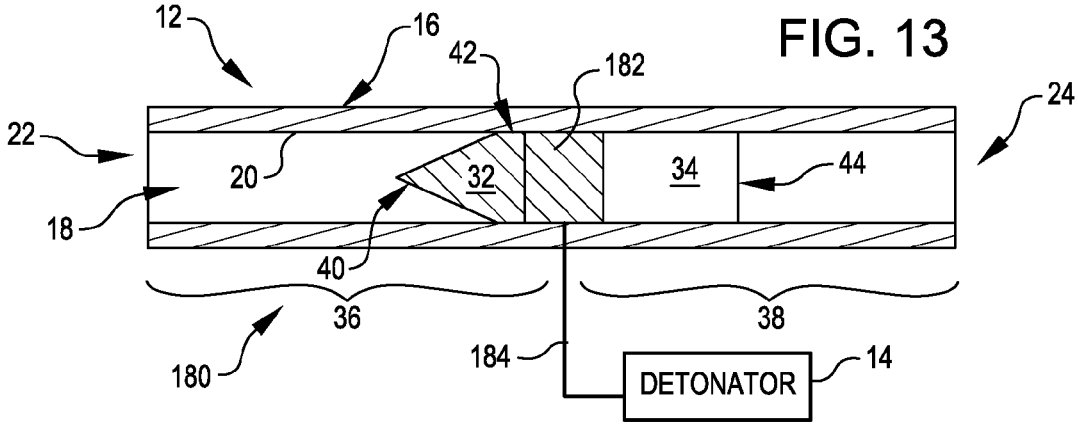
FIG. 13 is a diagram of an unguided-projectile system according to an embodiment of the invention.

FIG. 13 is a diagram of an unguided-projectile system 180 according to an embodiment of the invention. The system 180 is similar to the system 10 of FIG. 1 except that the divider 26 (FIG. 1) is omitted and the propellants 28 and 30 (FIG. 1) are combined into a single charge 182 that is detonated via a single wire 184.

The preceding discussion is presented to enable a person skilled in the art to make and use the invention. Various modifications to the embodiments will be readily apparent to those skilled in the art, and the generic principles herein may be applied to other embodiments and applications without departing from the spirit and scope of the present invention. Thus, the present invention is not intended to be limited to the embodiments shown, but is to be accorded the widest scope consistent with the principles and features disclosed herein.

What is claimed is:

1. A projectile accelerator, comprising:

a first continuous barrel having first and second ends;

first and second charges disposed within the barrel;

a first projectile disposed within the barrel between the first charge and the first end and operable, in response to detonation of the first charge, to exit the barrel via the first end and to travel through a liquid at a speed sufficient to cavitate a region of the liquid about the traveling first projectile; and a second projectile disposed within the barrel between the second charge and the second end and operable to exit the barrel via the second end in response to the detonation of the second charge.

2. The projectile accelerator of claim 1 wherein the barrel is cylindrical.

3. The projectile accelerator of claim 1 wherein the first and second ends of the barrel are open.

4. The projectile accelerator of claim 1 wherein the first projectile is tapered toward the first end of the barrel.

5. The projectile accelerator of claim 1, further comprising a detonator operable to detonate the first and second charges substantially simultaneously.

6. The projectile accelerator of claim 1, further comprising a detonator having no moving parts and operable to detonate the first and second charges substantially simultaneously.

7. The projectile accelerator of claim 1, further comprising:

a third charge disposed within the barrel between the first projectile and the first end;

a fourth charge disposed within the barrel between the second projectile and the second end;

a third projectile disposed within the barrel between the third charge and the first end and operable to exit the barrel via the first end in response to detonation of the third charge; and a fourth projectile disposed within the barrel between the fourth charge and the second end and operable to exit the barrel via the second end in response to the detonation of the fourth charge.

8. The projectile accelerator of claim 1, further comprising:

a third charge disposed within the barrel between the first projectile and the first end;

a fourth charge disposed within the barrel between the second projectile and the second end;

a third projectile disposed within the barrel between the third charge and the first end and operable to exit the barrel via the first end in response to detonation of the third charge;

a fourth projectile disposed within the barrel between the fourth charge and the second end and operable to exit the barrel via the second end in response to the detonation of the fourth charge; and a detonator operable to detonate the third and fourth charges substantially simultaneously.

9. The projectile accelerator of claim 1, further comprising a divider disposed within the barrel between the first and second charges.

10. The projectile accelerator of claim 1 wherein the first charge contacts the second charge.

11. The projectile accelerator of claim 1 wherein the first charge and the second charge form a single charge.

12. The projectile accelerator of claim 1, further comprising:

an enclosure having first and second ends;

third and fourth charges disposed within the enclosure;

a third projectile disposed within the enclosure between the third charge and the first end and operable to exit the enclosure via the first end in response to detonation of the third charge; and a fourth projectile disposed within the enclosure between the fourth charge and the second end and operable to exit the enclosure via the second end in response to the detonation of the fourth charge.

13. The projectile accelerator of claim 1, further comprising:

an enclosure having first and second ends;

third and fourth charges disposed within the enclosure;

a third projectile disposed within the enclosure between the third charge and the first end and operable to exit the enclosure via the first end in response to detonation of the third charge;

a fourth projectile disposed within the enclosure between the fourth charge and the second end and operable to exit the enclosure via the second end in response to the detonation of the fourth charge; and a detonator operable to detonate the third and fourth charges substantially simultaneously.

14. The projectile accelerator of claim 1 wherein:

the first projectile has a first shape; and the second projectile has a second shape that is significantly different than the first shape.

15. The projectile accelerator of claim 1 wherein the first and second projectiles have significantly different drag characteristics.

16. The projectile accelerator of claim 1 wherein:

the first projectile is operable to exit the barrel via the first end with a momentum in response to detonation of the first charge; and the second projectile is operable to exit the barrel via the second end with substantially the same momentum in response to the detonation of the second charge.

17. A projectile accelerator, comprising:

a first continuous barrel having first and second ends;

first and second charges disposed within the barrel;

a first projectile disposed within the barrel between the first charge and the first end and operable to exit the barrel via the first end in response to detonation of the first charge;

a second projectile disposed within the barrel between the second charge and the second end and operable to exit the barrel via the second end in response to the detonation of the second charge;

wherein after exiting the barrel the first projectile is operable to experience a first level of liquid drag; and wherein after exiting the barrel the second projectile is operable to experience a second level of liquid drag that is significantly greater than the first level.

18. A projectile accelerator, comprising:

an enclosure having first and second ends;

first and second charges disposed within the enclosure, the first charge contacting the second charge;

a first projectile disposed within the enclosure between the first charge and the first end and operable to exit the enclosure via the first end in response to detonation of the first charge; and a second projectile disposed within the enclosure between the second charge and the second end and operable to exit the enclosure via the second end in response to the detonation of the second charge.

19. A projectile accelerator, comprising:

an enclosure having first and second ends;

a charge disposed within the enclosure;

a first projectile disposed within the enclosure between the charge and the first end and operable to exit the enclosure via the first end in response to detonation of the charge; and a second projectile disposed within the enclosure between the charge and the second end and operable to exit the enclosure via the second end in response to the detonation of the charge.

20. A projectile accelerator, comprising:

an enclosure having first and second ends;

first and second charges disposed within the enclosure;

a first projectile disposed within the enclosure between the first charge and the first end, having a first shape, and operable to exit the enclosure via the first end' at a first velocity relative to the enclosure in response to detonation of the first charge; and a second projectile disposed within the enclosure between the second charge and the second end, having a second shape that is significantly different than the first shape, and operable to exit the enclosure via the second end at a second velocity relative to the enclosure in response to the detonation of the second charge, the second velocity being significantly different than the first velocity.

21. The projectile accelerator of claim 20 wherein:

the first projectile is operable to exit the enclosure via the first end with a momentum in response to detonation of the first charge; and the second projectile is operable to exit the enclosure via the second end with substantially the same momentum in response to the detonation of the second charge.

22. A projectile accelerator, comprising:

an enclosure having first and second ends;

first and second charges disposed within the enclosure;

a first projectile disposed within the enclosure between the first charge and the first end, having a tapered leading end, and operable to exit the enclosure via the first end in response to detonation of the first charge; and a second projectile disposed within the enclosure between the second charge and the second end, having a substantially flat leading end, and operable to exit the enclosure via the second end in response to the detonation of the second charge.

23. A projectile accelerator, comprising:

an enclosure having first and second ends;

first and second charges disposed within the enclosure;

a first projectile disposed within the enclosure between the first charge and the first end, having a first shape, and operable to exit the enclosure via the first end in response to detonation of the first charge;

a second projectile disposed within the enclosure between the second charge and the second end, having a second shape that is significantly different than the first shape, and operable to exit the enclosure via the second end in response to the detonation of the second charge; and wherein the first and second shapes impart significantly different drag characteristics to the first and second projectiles.

24. A projectile accelerator, comprising:

an enclosure having first and second ends;

first and second charges disposed within the enclosure;

a first projectile disposed within the enclosure between the first charge and the first end, having a first shape, and operable to exit the enclosure via the first end in response to detonation of the first charge;

a second projectile disposed within the enclosure between the second charge and the second end, having a second shape that is significantly different than the first shape, and operable to exit the enclosure via the second end in response to the detonation of the second charge; and wherein the first and second shapes impart significantly different effective masses to the first and second projectiles.

25. A projectile accelerator, comprising:

a continuous barrel having first and second ends;

first and second charges disposed within the barrel;

a first projectile disposed within the barrel between the first charge and the first end, having a tapered front end, and operable to exit the barrel via the first end in response to detonation of the first charge; and a second projectile disposed within the barrel between the second charge and the second end, having a substantially flat front end, and operable to exit the barrel via the second end in response to the detonation of the second charge.

26. A projectile accelerator, comprising:

a continuous barrel having first and second ends;

first and second charges disposed within the barrel;

a first projectile disposed within the barrel between the first charge and the first end and operable to exit the barrel via the first end at a first velocity relative to the barrel in response to detonation of the first charge; and a second projectile disposed within the barrel between the second charge and the second end and operable to exit the barrel via the second end at a second velocity relative to the barrel in response to the detonation of the second charge, the second velocity being significantly different from the first velocity.

27. A projectile accelerator, comprising:

a continuous barrel having first and second ends;

first and second charges disposed within the barrel;

a first projectile disposed within the barrel between the first charge and the first end and operable to exit the barrel via the first end in response to detonation of the first charge;

a second projectile disposed within the barrel between the second charge and the second end and operable to exit the barrel via the second end in response to the detonation of the second charge; and wherein the first and second projectiles have significantly different effective masses.

* * * * *

UNITED STATES PATENT AND TRADEMARK OFFICE

CERTIFICATE OF CORRECTION

PATENT NO. : 7,814,696 B2
APPLICATION NO. : 11/264299
DATED : October 19, 2010
INVENTOR(S) : John Rapp et al.

It is certified that error appears in the above-identified patent and that said Letters Patent is hereby corrected as shown below:

In Claim 20, Column 16, Line 55 of the patent, "exit the enclosure via the first end' at a first" should read -- exit the enclosure via the first end at a first --.

Signed and Sealed this
Twenty-ninth Day of March, 2011

David J. Kappos

David J. Kappos
*Director of the United States Patent and Trademark Office*